US007419180B2

(12) United States Patent
Bobrowicz

(10) Patent No.: US 7,419,180 B2
(45) Date of Patent: Sep. 2, 2008

(54) GLIDING BOARD

(75) Inventor: Eric Bobrowicz, Monetier les Bains (FR)

(73) Assignee: Skis Rossignol, Moirans (FR)

( * ) Notice: Subject to any disclaimer, the term of this patent is extended or adjusted under 35 U.S.C. 154(b) by 273 days.

(21) Appl. No.: 11/302,383

(22) Filed: Dec. 14, 2005

(65) Prior Publication Data

US 2006/0181061 A1 Aug. 17, 2006

(30) Foreign Application Priority Data

Feb. 16, 2005 (FR) ..... 05 50433
Apr. 26, 2005 (FR) ..... 05 51079

(51) Int. Cl.
*A63C 5/00* (2006.01)

(52) U.S. Cl. ..... 280/602; 280/610

(58) Field of Classification Search ..... 280/602, 280/609, 610, 11.14
See application file for complete search history.

(56) References Cited

U.S. PATENT DOCUMENTS

| | | | | |
|---|---|---|---|---|
| 2,369,004 A | | 2/1945 | Andreef | |
| 4,071,264 A | * | 1/1978 | Legrand et al. | 280/610 |
| 4,221,400 A | * | 9/1980 | Powers | 280/602 |
| 4,420,523 A | * | 12/1983 | Wieme | 428/109 |
| 4,690,850 A | * | 9/1987 | Fezio | 428/105 |
| 5,299,822 A | * | 4/1994 | Mayr et al. | 280/610 |
| 5,498,016 A | * | 3/1996 | Jodelet | 280/602 |
| 5,695,209 A | * | 12/1997 | Deborde et al. | 280/610 |
| 5,803,478 A | * | 9/1998 | Gavalis | 280/601 |
| 5,884,932 A | * | 3/1999 | Ignatius | 280/602 |
| 6,679,513 B1 | * | 1/2004 | Emig et al. | 280/602 |
| 6,886,848 B2 | * | 5/2005 | Riepler | 280/602 |
| 2005/0161908 A1 | | 7/2005 | Puget | |

FOREIGN PATENT DOCUMENTS

| | | |
|---|---|---|
| DE | 40 33 780 A1 | 5/1991 |
| EP | 1 166 832 A1 | 1/2002 |
| FR | 2 546 413 A | 11/1984 |
| FR | 2 699 827 A | 7/1994 |
| FR | 2 855 427 A | 12/2004 |

* cited by examiner

*Primary Examiner*—Christopher Ellis
*Assistant Examiner*—Brian Swenson
(74) *Attorney, Agent, or Firm*—Browdy and Neimark

(57) ABSTRACT

The invention relates to a snow gliding board (1) having a sidecut (2) that widens from the middle area (3) of the board towards at least one of its ends to a point of maximum width (4) and of which the structure includes a reinforcing fiber mat (10) comprising yarns (11) that extend in the longitudinal direction of the board.

It is characterised in that the number of yarns (11) per unit of length, measured across the board, varies from the middle area (3) towards the point of maximum width (4) of the board.

16 Claims, 3 Drawing Sheets

Fig. 1
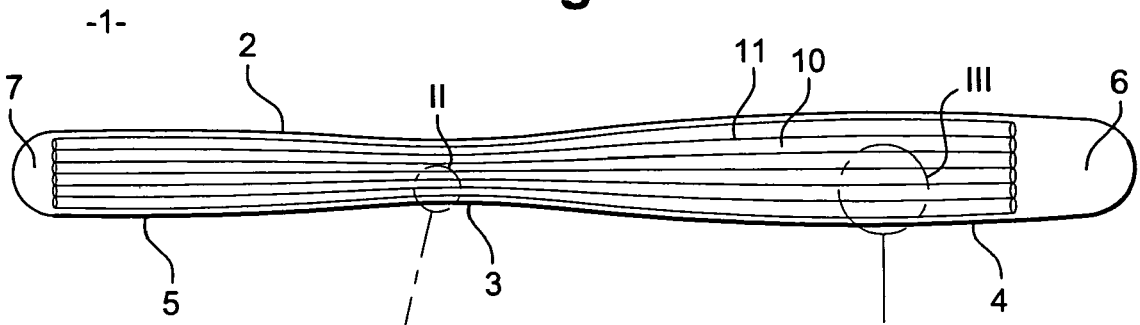
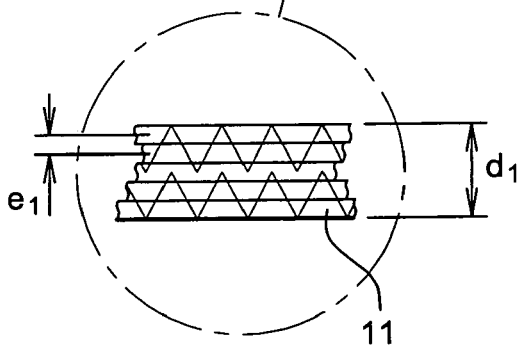
Fig. 2
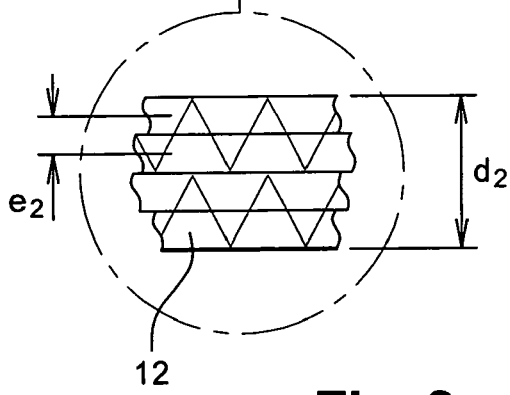
Fig. 3

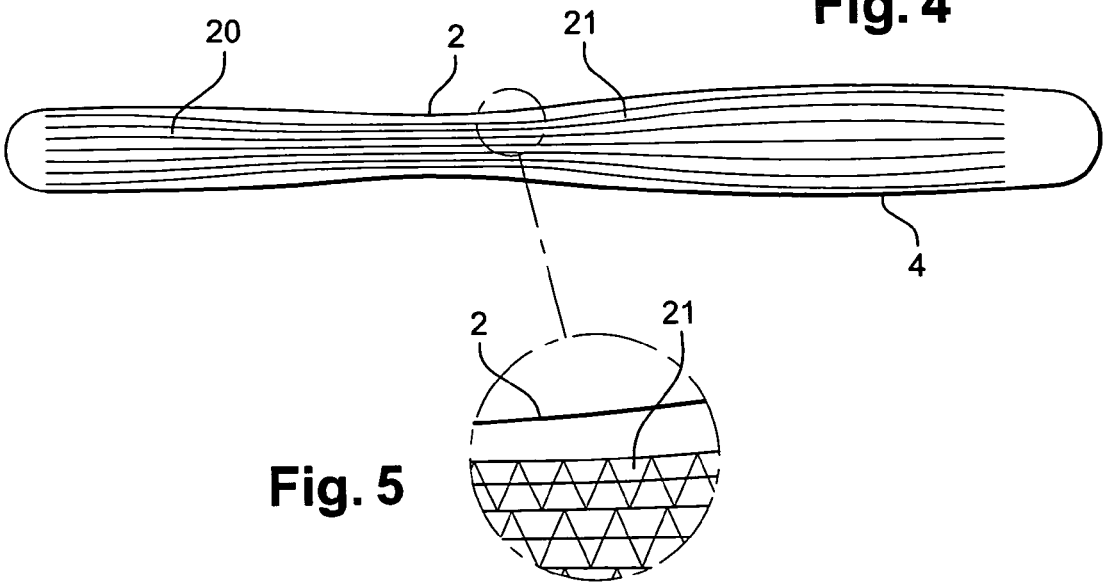
Fig. 4
Fig. 5
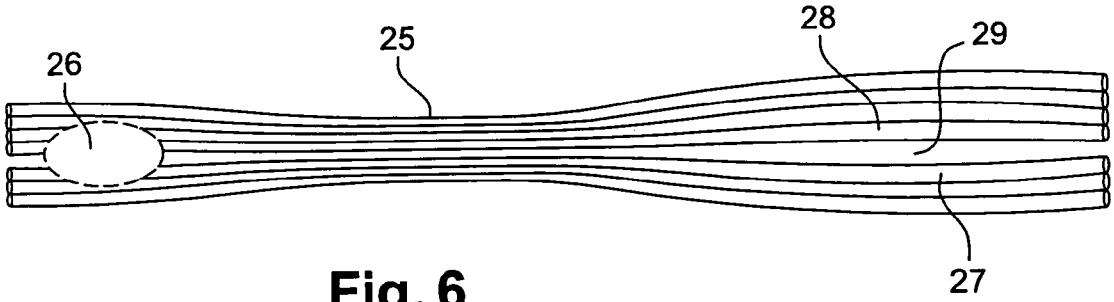
Fig. 6
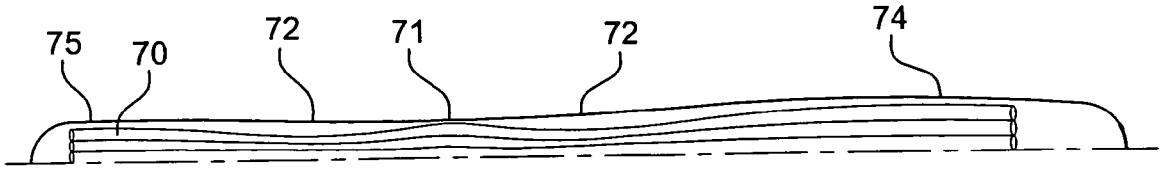
Fig. 7

-30-

-40-

GLIDING BOARD

FIELD OF THE INVENTION

The present invention relates to the field of manufacturing gliding boards, especially snow gliding boards. It relates more specifically to a new gliding board structure that includes a special mechanical textile stiffener.

PRIOR ART

Generally speaking, gliding boards used on snow, whether they are skis or snowboards, have a structure that includes mechanical stiffeners intended to reinforce their longitudinal rigidity.

Stiffeners used include fibrous structures, especially reinforcing fibre mats based on fibre glass impregnated with a thermosetting resin. These stiffeners assume various forms but always comprise a number of yarns that extend in the longitudinal direction of the gliding board. These various yarns can be assembled by weaving in order to form an essentially unidirectional stiffener. It is also possible to associate a layer of longitudinal yarns with a support layer, for example by stitching or bonding.

Also, it is known that gliding boards have a sidecut which can be more or less dished depending on the type of board so that the width of the board changes (generally, it increases) from the central area of the board towards its ends.

Consequently, the width of the reinforcing fibre mats mentioned above and built into the structure of these boards also varies. Such a stiffener is therefore obtained by cutting out strips suitable for the geometry of the board from a textile complex. This cutting out has a certain number of drawbacks.

During manufacture, the reinforcing fibre mat is handled in order to place it in a mould so that it can be associated with the rest of the structure of the board, either by moulding using an existing punch or by injecting polyurethane components in situ. The widest areas of the reinforcing fibre mat therefore have a certain number of short yarns at the edges of the cut-out strip. These short yarns are relatively loosely secured compared with the rest of the fibre mat and there are therefore risks of fraying.

The yarns that stick out of the fibre mat do not position themselves normally during moulding of the board. They then cause visual imperfections and structural flaws that may make it necessary to scrap the board.

In addition, these relatively short yarns only have a very limited effect on the stiffness which the stiffener is expected to provide because they extend over a very small fraction of the length of the board. However, these same yarns are impregnated with resin and therefore increase the weight of the stiffener at the widest part of the board. It is always desirable to make gliding boards lighter and the extra mass created by these yarns which have no effect on the stiffness of the board can be regarded as superfluous.

In addition, the fact that reinforcing fibre mat is wider in the widest areas of the ski results in the rigidity of the board being increased in these areas. It has been observed that this enhanced reinforcement might not offer any particular benefit and may increase the weight of the board unnecessarily.

In fact, in the special case of snowboards, it has been observed that the most mechanically stressed areas and hence the most fragile areas are those located immediately in front and behind the safety bindings, whereas existing stiffeners give the board extra rigidity in the areas where the tips begin because the board is widest in these areas.

One problem that the invention therefore aims to solve is that of optimising the stiffness afforded by reinforcing fibre mats on the surface of the board.

Making stiffeners having complex shapes has been suggested as a solution to this problem.

Document FR 2 546 413 describes skis having stiffeners consisting of several juxtaposed elements and made of different materials. It is obviously apparent that this construction is relatively complicated and requires delicate handling during manufacture.

Reinforcing fibre mats having a complex shape are also proposed in Document FR 2 855 427 but they comprise a number of cut-outs which aggravate the problems of fraying mentioned earlier. In Document FR 2 699 827, the Applicant describes stiffeners consisting of textile tape, the shape of which substantially matches itself to the sidecut. This solution is not entirely satisfactory in as much as the tapes are placed one above the other in the central area of the ski and create extra thickness that may be visible on the upper surface of the ski.

The object of the invention is therefore to provide a reinforcing structure that makes it possible to optimise distribution of the additional stiffness conferred by the stiffener without thereby aggravating handling constraints at the time of manufacture.

SUMMARY OF THE INVENTION

The invention therefore relates to a snow gliding board. This board has a sidecut that widens from the middle area of the board towards the ends of the board. This board has a structure that includes at least one reinforcing fibre mat comprising yarns in the longitudinal direction of the board.

In accordance with the invention, the reinforcing fibre mat is such that the number of yarns per unit of length measured across the board varies from the narrowest area of the board towards the point(s) of maximum width of the board, i.e. the widest area(s) of the board.

In other words, the reinforcing fibre mat used has a yarn density which, rather than being constant, gradually changes over the length of the board.

Put another way, the yarns of the reinforcing fibre mat may be further apart (or closer together) in certain locations on the board which are therefore equivalent to areas where the longitudinal-yarn density is lower (or higher).

In practice, it is possible to obtain variation of this density in different ways, depending on the properties which one wishes to give the board.

Thus, in a first embodiment, the number of yarns per unit of length, measured crosswise, may initially increase from the middle area towards the areas in which the bindings are mounted and then reduce beyond there towards the point(s) where the board is widest. In other words, in this case the density of the reinforcing yarns is highest in the vicinity of the areas where a binding is mounted and these are the areas that are most mechanically stressed and therefore benefit from increased reinforcement.

In a second embodiment, the number of yarns per unit of length, measured crosswise, may diminish as the sidecut widens.

In other words, the reinforcing fibre mat used has a yarn density which is highest in the middle area of the board, i.e. the area where the board is narrowest. The longitudinal-yarn density of the reinforcing fibre mat reduces and is therefore less in the widest area of the board. In this way, the reinforcing fibre mat increases the stiffness of the board in its widest area, but to a lesser extent than if the density of the reinforcing fibre mat was constant.

Put another way, the yarns of the reinforcing fibre mat are farther apart from each other in the widest area of the board than they are in the middle part of the board where it is generally narrowest.

In practice, in a first embodiment, the reinforcing fibre mat may extend over the entire width of the board in the area where it is present. In other words, the reinforcing fibre mat is stretched crosswise in order to follow the sidecut so that the selvedges of the stiffener consist of a single continuous yarn which eliminates any risk of the fraying mentioned earlier.

In this case, the number of yarns per unit of length, measured crosswise, is inversely proportional to the width of the board because the stiffener has a constant number of yarns that are distributed over a width. that increases as the width of the board increases.

In one variant, the reinforcing fibre mat may not extend over the entire width of the board. It then has selvedges that diverge slightly from the sidecut in certain areas of the board while becoming wider.

In practice, the distinctive reinforcing fibre mat may extend over almost the entire length of the board, typically from one line of contact to the other. It may also only be present over part of the length of the board, for example in those areas that require mechanical reinforcement. It is also possible to combine several reinforcing fibre mats that have a variable density. These mats can be placed one above the other, i.e. overlap each other partially or completely or even be juxtaposed, i.e. arranged so that they do not touch each other in various areas of the board.

In practice, adjustment of the optimum density of the reinforcing yarns can be improved and accentuated by making openings inside the reinforcing fibre mat. These openings can be made by cutting out and removing material from inside the fibre mat or by making the actual fibre mat so that certain yarns are sufficiently spread apart to form these openings due to the absence of reinforcing yarns.

In practice, various reinforcing textile structures can be used to produce boards in accordance with the invention.

In a first embodiment, the reinforcing fibre mat may comprise at least two layers placed one above the other, namely a first layer formed by a mat of yarns that extend longitudinally and a second support layer to which the reinforcing yarns are attached. In this case, the support layer may advantageously have a structure capable of deformation in the transverse direction of the board to enable stretching of the complex thus formed and a reduction in the number of yarns per unit of length in the characteristic areas.

In another embodiment, the reinforcing fibre mat may consist of a weave of a plurality of main yarns extending longitudinally along the board with perpendicular yarns that advantageously have the ability to stretch. In this case, these stretchable yarns extend crosswise to the board. They may be deformed in order to spread the main reinforcing yarns apart in those areas which require this.

In practice, it is also possible to vary the reinforcing properties in the transverse direction of the stiffener. In fact, it is possible to use reinforcing yarns which have properties that differ, especially in terms of their nature or size, over the width of the reinforcing mat.

Thus, by way of example, one can use carbon, glass or aramid yarns which have different mechanical properties and are arranged over the width of the stiffener and distributed in a manner that depends on the mechanical properties that one wishes to give the board. Thus, to produce a snowboard, one can give preference to using yarns with the highest tenacity on the edges of the stiffener because these areas are intended to be located close to the edges that are subjected to the highest stresses.

It is also possible to use yarns having different sizes that are also distributed appropriately across the width of the board. The larger size yarns can be located, as in the above example, near the selvedges of the stiffener in the case of gliding boards or in the middle area, possibly with crosswise gradation of the yarn size, depending on the degree of reinforcement that one wishes to give the board.

BRIEF DESCRIPTION OF THE DRAWINGS

In order that the way in which the invention is implemented and its resulting advantages may more readily be understood, the following description is given, merely by way of example, reference being made to the accompanying drawings.

FIG. 1 is a top view of the board according to the invention in which the distinctive fibre mat is shown in a visible manner.

FIGS. 2 and 3 are detailed views equivalent to areas (II) and (III) in FIG. 1.

FIG. 4 is a top view of another embodiment of a board according to the invention in which the distinctive fibre mat is shown in a visible manner.

FIG. 5 is a detailed view equivalent to area V in FIG. 4.

FIG. 6 is a top view of a reinforcing fibre mat made in accordance with another embodiment.

FIG. 7 is a top view of a reinforcing fibre mat made in accordance with still another embodiment.

DESCRIPTION OF THE PREFERRED EMBODIMENTS

Figure 8:
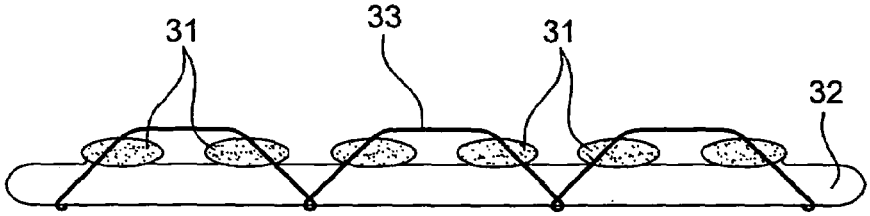
FIGS. 8 and 9 are cross-sectional views of a reinforcing fibre mat made according to a first embodiment, shown at two longitudinally distant areas of the board.
Figure 9:
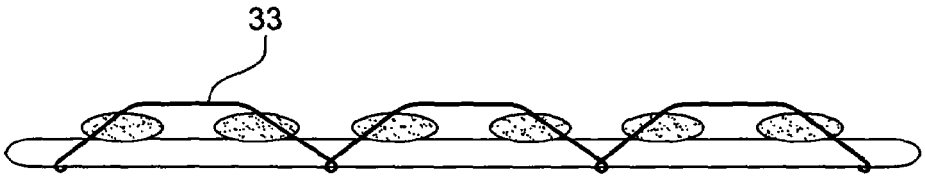

As shown in FIG. 1, a gliding board (1) has a sidecut (2) that corresponds to the lateral edges of the board and which is not straight. In fact, this sidecut (2) widens from the middle area (3) of the board towards the ends of the board.

This sidecut widens as far as point (4), the point of maximum width located towards the front of the board. The sidecut also widens towards the rear until a point of maximum width (5) is reached. Generally speaking, the ends of the board are upwardly-curved tapering areas that form a nose (6).

On certain types of skis, the rear end (7) may also be curved in order to form a rear ski-tip which is generally less raised.

The structure of the gliding board comprises, as stated earlier, a reinforcing fibre mat formed by a textile complex (10) essentially comprising yarns (11) oriented in the longitudinal direction of the board. These yarns (11) generally consist of high-tenacity yarns, especially glass yarns, but without excluding materials with similar properties such as carbon or aramid fibres on their own or in combination. These yarns are generally formed by contiguous rovings.

According to the invention, the various yarns (11) that ensure the rigidity of the reinforcing fibre mat (10) are not strictly parallel but spread apart as the board widens. Thus, as shown in FIG. 2, the number of yarns per unit of width ($d_1$) measured across the board is less than the number of yarns in the same unit of width ($d_2$) measured at the widest point of the board, a shown in FIG. 3.

The yarns (11) shown in detail in FIG. 2 are closer together and the distance between their centres ($e_1$) is relatively short. Conversely, as shown in FIG. 3, the yarns (12) are further apart and the distance between their centres ($e_2$) is greater. By way of example, the stiffeners conventionally used to manufacture skis comprise an assembly of 600 to 2400 tex rovings distributed at 5 yarns per centimeter with a centres spacing between yarns $e_1$ of the order of 2 mm in the area of the waist.

In one embodiment of the invention, the number of yarns per centimeter can be reduced to a value of 2 to 3 yarns per centimeter in the widest area (4).

The density of the reinforcing fibre mat inside the board reduces gradually towards the ski-tips. As a result the reinforcement provided by the mat (10) is less in the widest area of the board which is generally subjected to less mechanical stress.

One therefore obtains overall lightening of the board without adversely affecting its mechanical properties in terms of strength.

In the form shown in FIG. 1, the reinforcing fibre mat (10) has a width that is equivalent to that of the board and therefore follows the sidecut (2). The number of yarns per centimeter is therefore directly inversely proportional to the width of the board to the extent that the number of yarns in the fibre mat remains constant over its entire length.

In the embodiment shown in FIG. 4, the reinforcing fibre mat (20) widens to a certain extent but does not follow the sidecut (2) closely. The yarns (21) in the fibre mat (20) remain parallel in the area of the waist and in the area located directly in front of the waist area, although the board starts to widen in this area.

Yarns (21) that make up the fibre mat then spread apart in accordance with the invention towards the widest area (4) of the board. The density of the stiffener is therefore adjusted so that it is highest in the area where the mechanical stresses exerted are the highest, typically close to points in front of and behind the bindings.

According to another aspect of the invention, it may be advantageous to eliminate certain parts of the reinforcing fibre mat in those areas that do not require special reinforcement in order to reduce the weight of the board. This applies to snowboards in the middle of the board in the area located between the bindings. This lightening can therefore be achieved in different ways, as shown in FIG. 6.

It is possible to make an opening (26) by using a die, for example, to cut out and eliminate a particular area of the reinforcing fibre mat (25). It is also possible to ensure stretching of the stiffener (25) so that consecutive yarns (27, 28) are no longer contiguous, leaving an area between them (29) where there is no reinforcing yarn.

The embodiment shown in FIG. 7 corresponds to a stiffener (70) which has a yarn density that increases and diminishes over the length of the board. More precisely, in the middle area of the board (71), stiffener (70) extends substantially over the entire width of the board.

Further forward, in the areas (72) where the binding is mounted, the width of the stiffener (70) reduces and reaches its minimum value. Then, beyond this point towards the widest areas (74, 75) of the board, the stiffener also widens.

By way of example, this variation makes it possible to vary the density of the stiffener significantly, typically with a transition from a value of around 900 g/m$^2$ in the middle area (71) of the board increasing up to 1 100 g/m$^2$ in the areas where the binding is mounted and subsequently reducing to a value of around 700 g/m$^2$ in the widest area (74) of the board. Obviously, these values are given by way of example and they can be adapted to suit the type of board and the desired rigidity.

In practice, various structures can be used to achieve the distinctive effect of the invention.

As shown in FIG. 8, the various longitudinal yarns (31) of the stiffener (30) are associated with a support layer (32) typically formed by a mat or web of synthetic glass fibres. The longitudinal yarns (31) are attached to this support layer (32) by stitching (33). The support layer (32) shown in FIG. 7 has a degree of stretchability which enables it to widen, as shown in FIG. 8. The stitching thread (33) is also stretchable so that it adapts to deformation of support layer (32) which is irreversible.

Figure 10:
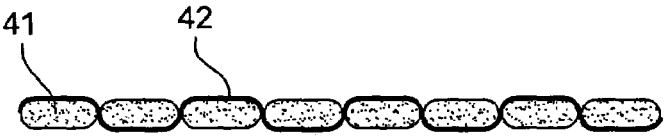
FIGS. 10 and 11 are cross-sectional views similar to FIGS. 8 and 9 for another embodiment of the reinforcing fibre mat.
Figure 11:
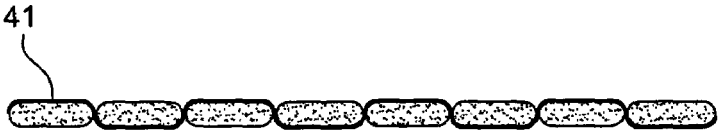

In the embodiment shown in FIG. 10, the stiffener (40) consists of a woven roving (41) with a very small weft thread (42) so as to produce little shrinkage. This weft thread (42) has the ability to stretch, preferably irreversibly, in order to allow stretching of the stiffener as shown in FIG. 11. By way of example, on a snowboard, this stretching may amount to almost 35%, altering the width of the mat from a minimum value of 240 mm to a value of 320 mm in the widest areas.

Figure 12:
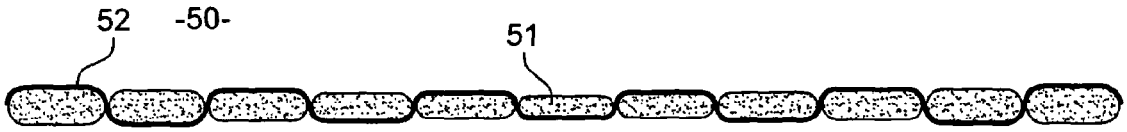
FIG. 12 is a cross-sectional view of a reinforcing fibre mat made with variable yarn sizes.

FIG. 12 shows an alternative embodiment in which the yarns of the stiffener (50) have different sizes. The yarns (51) located in a central area have a size that is less than the yarns (52) located on the edges of stiffener (50). Obviously, the reverse arrangement can be used with gradual variations compared with that shown in FIG. 12 or even marked variations with a smaller number of different yarns.

In practice, distinctive stiffeners can also be produced by using special looms with adjustable combs. These adjustable combs are known per se and have variable teeth spacing which can be programmed in real time as weaving of the stiffener progresses. Different types of adjustable combs can be used, especially combs that have various segments that can be oriented around an axis at a right angle to the fabric.

Other alternatives can be envisaged even though they are not shown, for instance using gauze type support structures or even weaving using weft threads with loops on them to facilitate subsequent stretching of the fabric.

The above description makes it apparent that gliding boards in accordance with the invention have many advantages, including:

- density of the fibre stiffener can be adapted to suit the distribution of mechanical stresses observed on the board;
- board can be lightened by eliminating stiffener areas that are less useful;
- board has smooth surface finish despite the presence of stiffeners having a non-constant thickness;
- ease with which stiffeners can be handled during the various stages of manufacture.

The invention claimed is:

1. A snow gliding board (1) having a sidecut that widens from a middle area (3) of the board towards at least one of its ends to a point of maximum width (4), and having a structure which includes a reinforcing fibre mat (10) comprising a plurality of yarns (11) that extend in the longitudinal direction of the board, wherein the number of yarns (11) per unit of width of the board, varies from the middle area (3) towards the point of maximum width (4) of the board.

2. A gliding board as claimed in claim 1, characterised in that the number of yarns per unit of width reaches it maximum value in the vicinity of areas (72) where bindings are mounted.

3. A gliding board as claimed in claim 1, characterised in that the number of yarns per unit of width increases from the middle area towards areas (72) where bindings are mounted and then diminishes beyond this point towards the point of maximum width (74) of the board.

4. A gliding board as claimed in claim 1, characterised in that the number of yarns per unit of width measured in the traverse direction reduces as the sidecut of the board widens.

5. A gliding board as claimed in claim 1, characterised in that the fibre mat (10) extends over the entire width of the board.

6. A gliding board as claimed in claim 1, characterised in that the number of yarns measured over the entire length of the fibre mat is constant over its entire length.

7. A gliding board as claimed in claim 1, characterised in that the reinforcing fibre mat extends over only part of the length of the board.

8. A gliding board as claimed in claim 1, characterised in that the board comprises several reinforcing fibre mats placed one above the other or juxtaposed.

9. A gliding board as claimed in claim 1, characterised in that the fibre mat (25) has openings.

10. A gliding board as claimed in claim 9, characterised in that the openings (26) are made by cutting out and removing material.

11. A gliding board as claimed in claim 9, characterised in that the openings (29) are made by spreading apart the yarns (27, 28).

12. A gliding board as claimed in claim 1, characterised in that the fibre mat comprises at least a first layer formed by a mat of yarns (31) extending in the longitudinal direction of the board and a second support layer (32) having a structure capable of deformation in the transverse direction of the board.

13. A gliding board as claimed in claim 1, characterised in that the fibre mat comprises a plurality of yarns (41) extending in the longitudinal direction of the board woven with a plurality of perpendicular yarns (42) that have the ability to stretch.

14. A gliding board as claimed in claim 1, characterised in that the yarns (51,52) of the reinforcing fibre mat have different properties, in terms of the nature or size thereof, over the width of said mat.

15. A snow gliding board (1) having a sidecut that widens from a middle area (3) of the board towards at least one of its ends to a point of maximum width (4), and having a structure which includes a reinforcing stiffner (10) comprising a plurality of yarns (11) that extend in the longitudinal direction of the board, wherein the distance between adjacent longitudinally extending yarns increases from a minimum distance at said middle area (3) to a maximum at the point of maximum width (4) of the board.

16. A gliding board as claimed in claim 15, characterised in that the number of yarns per unit of width reaches it maximum value in the vicinity of areas (72) where bindings are mounted.

* * * * *